United States Patent [19]

Iwai

[11] Patent Number: 4,645,365

[45] Date of Patent: Feb. 24, 1987

[54] PAPER FEED CONTROL IN A PRINTER

[75] Inventor: Hiroji Iwai, Yamatokoriyama, Japan

[73] Assignee: Sharp Kabushiki Kaisha, Osaka, Japan

[21] Appl. No.: 693,458

[22] Filed: Jan. 22, 1985

[30] Foreign Application Priority Data

Jan. 25, 1984 [JP] Japan ..... 59-14154

[51] Int. Cl.[4] ..... B41J 11/42; B41J 23/32

[52] U.S. Cl. ..... 400/568; 400/583; 400/551

[58] Field of Search ..... 400/568, 569, 902, 577, 400/551, 65, 611, 582, 583, 583.4

[56] References Cited

U.S. PATENT DOCUMENTS

| | | | |
|---|---|---|---|
| 3,749,221 | 7/1973 | Busch | 400/569 |
| 3,844,395 | 10/1974 | Mero et al. | 400/568 |

FOREIGN PATENT DOCUMENTS

| | | | |
|---|---|---|---|
| 2658904 | 7/1978 | Fed. Rep. of Germany | 400/568 |
| 49026 | 4/1979 | Japan | 400/577 |
| 55774 | 3/1984 | Japan | 400/551 |

OTHER PUBLICATIONS

Paulson, "Automatic Platen Indexing System", IBM Technical Disclosure Bulletin, vol. 18, No. 10, p. 335, 3/76.

*Primary Examiner*—William Pieprz

*Attorney, Agent, or Firm*—Birch, Stewart, Kolasch & Birch

[57] ABSTRACT

A paper feed system in a printer includes a platen for supporting a recording paper sheet, a paper feed drive motor, and a transmission gear mechanism for transferring the rotation of the paper feed drive motor to the platen so as to conduct an automatic paper feed operation. The paper feed system further allows a manual paper feed operation wherein the platen is manually rotated. A detection system is provided which detects the manual paper feed operation. If the manual paper feed operation has been conducted before the automatic paper feed operation, a compensating paper drive is first conducted when an automatic paper feed instruction is developed. In the compensating paper drive, the platen is first driven to rotate in the reverse direction by a predetermined amount and, then to rotate in the forward direction by the same amount, thereby compensating for the displacement of the paper sheet location caused by the backlash of the transmission gear mechanism during the manual paper feed operation.

3 Claims, 3 Drawing Figures

PAPER FEED CONTROL IN A PRINTER

BACKGROUND OF THE INVENTION

1. Field of the Invention

The present invention relates to a paper feed control system in a printer such as a typewriter and, more particularly, to a paper feed control system which compensates for a feed error caused by the backlash of the transmission gear mechanism.

2. Description of the Prior Art

A paper feed system in a printer, especially a typewriter, generally includes a platen for supporting a recording paper sheet. The platen is mechanically connected to a paper feed drive motor such as a pulse motor via a transmission gear mechanism. The platen is rotated by the paper feed drive motor so that the recording paper sheet mounted on the platen is fed forward or backward (reverse) so as to position the recording paper sheet at a desired location.

In such a paper feed system, accurate paper placement is difficult to control due to backlash in the transmission gear mechanism which is disposed between the platen and the paper feed drive motor, or due to looseness included in the bearing portion of the transmission gear mechanism.

The backlash greatly influences the accuracy of the paper sheet placement if the printing operation is conducted after a certain amount of forward feed, and then the printing operation is carried out subsequent to a certain amount of reverse feed. Therefore, in the conventional system, when the reverse feed is conducted, the reverse feed is first conducted to a predetermined amount which is greater than a desired amount by an excess distance corresponding to several pulses, and then, the forward feed is carried out by the excess distance so as to minimize the positioning error caused by the backlash.

However, as is well known, the paper feed can be manually conducted in addition to the motor driven automatic feed. In the manual feed operation, the platen is manually rotated to shift the recording paper sheet around the platen. In the conventional system, the positioning error caused by the backlash can not be compensated for when the manual feed is conducted between sequential two operations of the motor driven automatic feed. More specifically, when the motor driven automatic feed is conducted after the manual forward feed or the manual reverse feed, the motor driven automatic feed is carried out from a position which includes the backlash error created in the manual feed operation.

OBJECTS AND SUMMARY OF THE INVENTION

Objects of the Invention

Accordingly, an object of the present invention is to provide a novel paper feed control system in a printer such as a typewriter.

Another object of the present invention is to minimize the paper positioning error caused by the backlash of the transmission gear mechanism which is disposed between a platen and a paper feed drive motor.

Still another object of the present invention is to minimize the paper positioning error caused by the backlash of the transmission gear mechanism even when the manual paper feed is conducted sequentially between two operations of the motor driven automatic paper feed.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Summary of the Invention

To achieve the above objects, pursuant to an embodiment of the present invention, a detection system is disposed in a printer in order to detect whether the manual paper feed is conducted. If the manual feed is conducted, the detection system develops a detection signal which is stored in a state storage element. When the automatic paper feed operation is to be carried out, the control system first checks the condition of the state storage element. If the state storage element shows that the manual paper feed has been conducted, the automatic paper feed is first conducted in the reverse direction by a preselected distance and then the automatic paper feed is conducted in the forward direction by the distance identical to the above-mentioned preselected distance. Thereafter, the actual printing operation is conducted. By this reverse and forward paper drive before initiating the actual printing operation, the backlash error due to the manual paper feed is minimized.

BRIEF DESCRIPTION OF THE DRAWINGS

The present invention will be better understood from the detailed description given hereinbelow and the accompanying drawings which are given by way of illustration only, and thus are not limitative of the present invention and wherein.

DESCRIPTION OF THE PREFERRED EMBODIMENTS

A paper feed control system of the present invention includes a manual paper feed detection unit which detects whether the manual paper feed is conducted. The manual paper feed detection unit includes two sensing devices. The first sensing device includes a slit plate secured to a rotating shaft of a paper feed drive motor, and an optical detection unit associated with the slit plate. The second sensing device includes a detection member associated with a clutch mechanism of the transmission gear mechanism which is disposed between a platen and a paper feed drive motor.

The first sensing device is effective to detect a first manual operation mode wherein the manual paper feed is conducted by rotating a knob secured to the platen while the platen is mechanically connected to the shaft of the paper feed drive motor via the clutch mechanism. The second sensing device is effective to detect a second manual feed operation mode wherein the platen is manually rotated in order to conduct a fine adjustment while the platen is disconnected from the paper feed drive motor through the use of the clutch mechanism.

The first sensing device includes a slit plate 10 secured to the rotating shaft of the paper feed drive motor, a light emitting element 12, and a light responsive element 14 which detects the light beam emitted from the light emitting element 12 and passing through the slit plate 10. In the first mode of manual operation, the rotating shaft of the paper feed drive motor is manually rotated via the platen and the clutch mechanism. That is, the slit plate 10 rotates when the first mode of manual paper feed is conducted.

Figure 3:
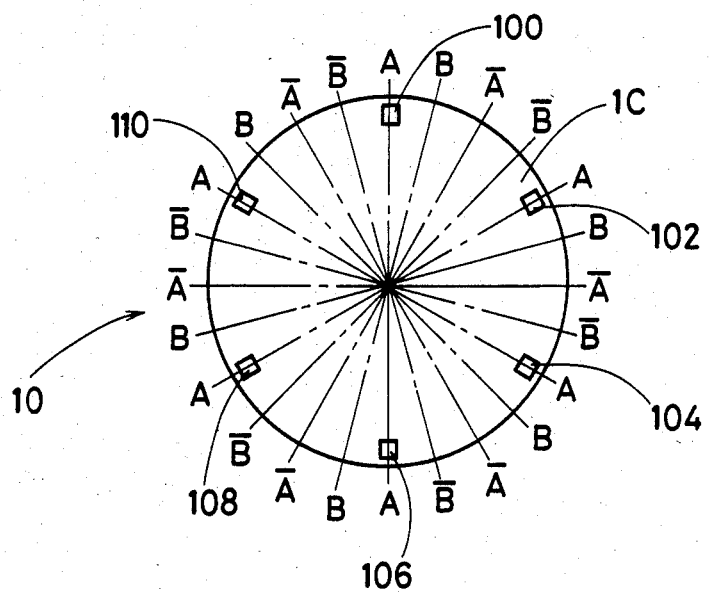
FIG. 3 is a plan view of a slit plate included in the paper feed control system of FIG. 1.

The slit plate 10 is provided with slits 100, 102, 104, 106, 108 and 110 as shown in FIG. 3. In the automatic paper feed operation, the paper feed drive motor (four-phase pulse motor) is controlled in a fixed phase relationship. More specifically, the motor drive is conducted in the four step unit, namely $A \rightarrow B \rightarrow \bar{A} \rightarrow \bar{B} \rightarrow A$, and the motor rotation is controlled in a manner that the paper feed drive motor is stopped at the phase of A. The slits 100, 102, 104, 106, 108 and 110 are provided at positions corresponding to the above-mentioned phase A.

Accordingly, if the first mode of manual feed is conducted, the slit plate 10 rotates to repeatedly interrupt the light beam emitted from the light emitting element 12. A first detection output (+Vcc) is generated on an output line 16 when the light responsive element 14 does not receive the light beam emitted from the light emitting element 12. That is, the detection output (+Vcc) indicates that the first mode of manual paper feed is conducted. While the first mode of manual paper feed is conducted, the paper feed drive motor is subject to the A phase control and, therefore, the paper feed drive motor is stopped at the position corresponding to the phase of A by means of the electrical detent force.

The second sensing device includes a sensor 20 associated with the clutch mechanism which is disposed between the platen and the paper feed drive motor. The sensor 20 develops a second direction output (−Vcc) on an output line 22 when the clutch mechanism is disconnected.

The output lines 16 and 22 are connected to an OR gate 30. That is, the first and second detection outputs are introduced into the OR gate 30. An output signal of the OR gate 30 is introduced into an input terminal of an AND gate 32. An output signal of the AND gate 32 is introduced into a set input terminal of a state memory device (flip-flop) 34. The other input terminal of the AND gate 32 is connected to receive a motor drive signal MD, which controls the paper feed drive motor, via an inverter 36. Accordingly, the AND gate 32 is disabled when the automatic paper feed is conducted by the paper feed drive motor, and the AND gate 32 is enabled when the automatic paper feed is not conducted, during which the manual paper feed can be conducted.

If the manual paper feed operation is conducted while the automatic paper feed is not being conducted, either one of the first and second sensing devices detects the manual paper feed operation, and develops the detection output. The detection output is temporarily stored in the state memory device (flip-flop) 34. That is, the set state of the state memory device (flip-flop) 34 indicates that the manual paper feed operation has been conducted. Contrarily, the reset state of the state memory device (flip-flop) 34 indicates that the manual paper feed operation has not been conducted.

Figure 1:
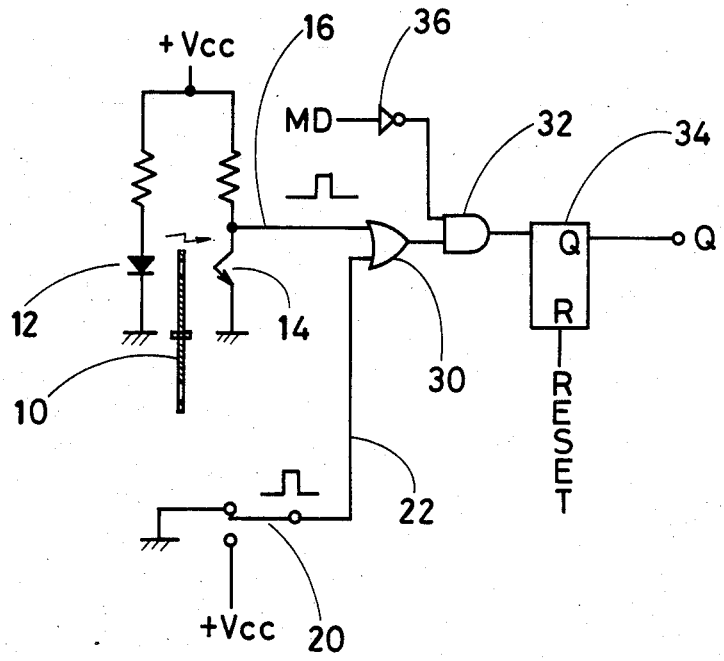
FIG. 1 is a circuit diagram of an essential part of an embodiment of a paper feed control system of the present invention.
Figure 2:
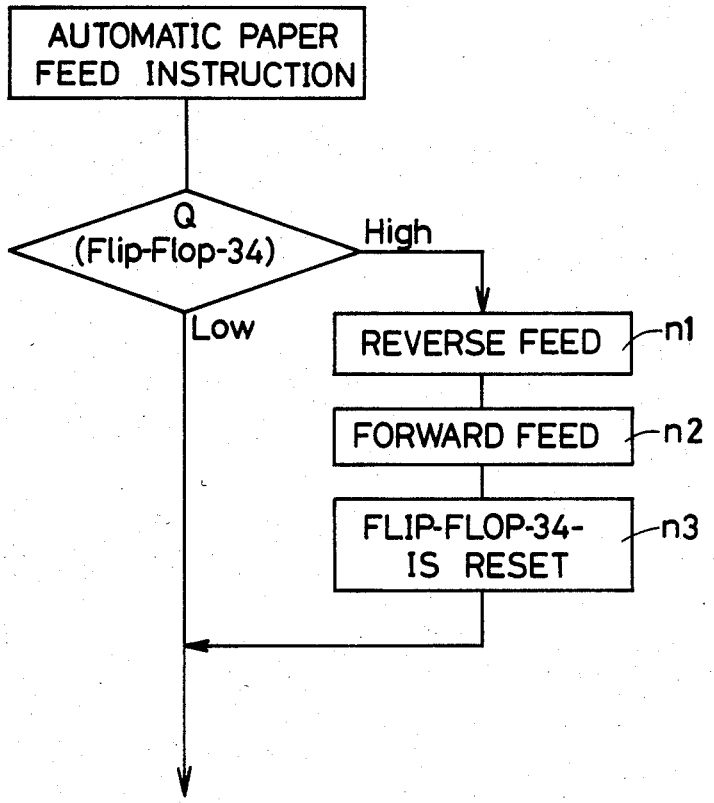
FIG. 2 is a flow chart for explaining an operational mode of the paper feed control system of the present invention.

When the automatic paper feed instruction is developed in the actual printing operation, the control system first checks the condition of the state memory device (flip-flop) 34 as shown in FIG. 2. If the state memory device (flip-flop) 34 is in the set state, a compensating operation of steps n1, n2 and n3 is first conducted and, then, the actual paper feed operation is conducted.

More specifically, if the manual paper feed operation has been conducted before the actual automatic paper feed operation, that is, if the state memory device (flip-flop) 34 is in the set state, the platen is driven to rotate in the reverse direction by a predetermined number of several pulses (step n1) and, then, the platen is driven to rotate forward by the predetermined number of several pulses (step n2) so as to compensate for the displacement caused by the backlash during the manual paper feed operation. When the compensating operation is completed, the state memory device (flip-flop) 34 is reset (step n3), and the actual automatic paper feed operation is conducted.

If the state memory device (flip-flop) 34 is in the reset state when the automatic paper feed instruction is developed, the compensating operation of the steps n1, n2 and n3 is not conducted. That is, the compensating operation is conducted only when the manual paper feed operation has been conducted before the actual automatic paper feed operation.

The invention being thus described, it will be obvious that the same may be varied in many ways. Such variations are not to be regarded as a departure from the spirit and scope of the invention, and all such modifications are intended to be included within the scope of the folowing claims.

What is claimed is:

1. A paper feed control system in a printer which includes a platen, a paper feed drive motor and a transmission gear mechanism disposed between said paper feed drive motor and said platen for conducting automatic paper feed, wherein a manual paper feed can be conducted when said platen is manually rotated, said paper feed control system comprising:

manual paper feed detection means for detecting whether a manual paper feed operation is conducted;

temporary storage means for temporarily storing a detection output of said manual paper feed detection means;

determination means for determining the condition of said temporary storage means when an automatic paper feed instruction is developed; and compensating drive means for rotating said platen in the reverse direction by a predetermined amount and, then, rotating said platen in the forward direction by said predetermined amount if said determination means determines that said manual paper feed detection means has detected a manual paper feed operation whereby prior to resuming automatic paper feed the platen is adjusted to reduce backlash error that is produced in conducting said manual paper feed.

2. The paper feed control system of claim 1, said manual paper feed detection means including:

a slit plate secured to a shaft of said paper feed drive motor;

an optical detection unit which develops a rotation sensing output when said slit plate rotates; and logic means for developing said detection output when said rotation sensing output is developed from said optical detection unit while an automatic paper feed operation is not being conducted.

3. The paper feed control system of claim 2, said printer further including a clutch mechanism disposed in said transmission gear mechanism, and said manual paper feed detection means further including:

a disconnection detection unit which develops a disconnection sensing output when said clutch mechanism is disconnected; and control means for developing said detection output when said disconnection sensing output is developed from said disconnection detection unit.

* * * * *